US010102965B2

(12) United States Patent
Wang

(10) Patent No.: US 10,102,965 B2
(45) Date of Patent: Oct. 16, 2018

(54) BARRIER ARRANGEMENT BETWEEN TRANSFORMER COIL AND CORE

(71) Applicant: ABB Technology AG, Zurich (CH)

(72) Inventor: Zepu Wang, Christiansburg, VA (US)

(73) Assignee: ABB Schweiz AG, Baden (CH)

( * ) Notice: Subject to any disclaimer, the term of this patent is extended or adjusted under 35 U.S.C. 154(b) by 61 days.

(21) Appl. No.: 15/174,538

(22) Filed: Jun. 6, 2016

(65) Prior Publication Data

US 2017/0352473 A1 Dec. 7, 2017

(51) Int. Cl.
*H01F 27/30* (2006.01)
*H01F 27/32* (2006.01)
*H01F 30/12* (2006.01)

(52) U.S. Cl.
CPC ..... *H01F 27/324* (2013.01); *H01F 27/30* (2013.01); *H01F 30/12* (2013.01)

(58) Field of Classification Search
CPC ..... H01F 27/00–27/36
USPC ..... 336/90, 196, 198, 199, 206–208
See application file for complete search history.

(56) References Cited

U.S. PATENT DOCUMENTS

| | | | | |
|---|---|---|---|---|
| 2,942,213 | A | 6/1960 | Carmilli et al. | |
| 3,024,298 | A | 3/1962 | Goltsos et al. | |
| 5,359,312 | A | 10/1994 | McQuay et al. | |
| 5,404,123 | A * | 4/1995 | Joseph | H01F 5/02 336/192 |
| 5,917,397 | A * | 6/1999 | Sasahara | H01F 27/323 336/198 |
| 7,788,794 | B2 | 9/2010 | Sarver et al. | |
| 7,990,245 | B1 | 8/2011 | Krichtafovitch | |
| 8,610,532 | B2 | 12/2013 | Singh et al. | |
| 9,111,677 | B2 | 8/2015 | Saver et al. | |
| 2010/0328005 | A1 | 12/2010 | Sarver et al. | |
| 2011/0248808 | A1 | 10/2011 | Singh et al. | |
| 2012/0212312 | A1 | 8/2012 | Johnson et al. | |
| 2013/0106546 | A1 | 5/2013 | Outten | |

FOREIGN PATENT DOCUMENTS

| | | |
|---|---|---|
| CN | 203706795 | 7/2014 |
| CN | 104167276 | 11/2014 |

OTHER PUBLICATIONS

Search Report and Written Opinion, PCT Appln. No. PCT/US17/035929, dated Sep. 27, 2017, 11 pgs.

* cited by examiner

*Primary Examiner* — Tuyen Nguyen
(74) *Attorney, Agent, or Firm* — Taft Stettinius & Hollister LLP

(57) ABSTRACT

A transformer includes a core having first and second yokes and at least one leg extending between the first and second yokes. The at least one leg includes a coil assembly mounted thereto between the first and second yokes. An annular end barrier is provided at one or both ends of the coil assembly to provide a barrier between the adjacent yoke and a high voltage winding of the coil assembly.

19 Claims, 4 Drawing Sheets

BARRIER ARRANGEMENT BETWEEN TRANSFORMER COIL AND CORE

FIELD OF THE INVENTION

This invention relates to transformers and more particularly to an end barrier that provides insulation between an electrical coil and a core of the transformer.

BACKGROUND

An electrical transformer converts electricity at one voltage to electricity at another voltage, either of higher or lower value. This voltage conversion is achieved using coil assembly that includes a primary coil and a secondary coil in the transformer, each of which are wound on a ferromagnetic core and comprise a number of turns of an electrical conductor. The primary coil is connected to a source of voltage and the secondary coil is connected to a load. The coil assembly is mounted to a leg of the core, and the core includes first and second yokes connected by the leg. Certain transformers include multiple legs and a coil assembly on each leg.

For dry type transformers, such as those with coils for open windings, an air distance has to be maintained between the yokes and an adjacent end of the coil assembly to maintain dielectric clearance. In dry transformers, the high voltage conductor of the coil assembly is not embedded in resin. Thus, the conductor is exposed to air except for a thin turn insulation on the conductor surface. Sufficient air clearance prevents flashover from the high voltage conductor to the grounded yoke of the core. Thus, the leg of the core on which the coil assembly is mounted has to be of sufficient length to provide both a desired coil assembly length and to maintain this air distance between the yokes and the adjacent ends of the coil assembly.

Therefore, a design which allows the air distance between the ends of the coil assembly and the adjacent yoke to be lessened reduces overall cost and space requirements for the transformer since less core material is required and the length of the leg of the core on which the coil assembly is mounted can be reduced. However, such a design cannot negatively affect the performance of the transformer. It would therefore be desirable to provide a transformer with a reduced air clearance gap between the coil assembly and the yokes of the core. The present invention is directed to such a transformer.

SUMMARY

In accordance with the present disclosure, a transformer is provided that includes a core with at least one leg extending between first and second yokes, a coil assembly around the at least one leg, and an annular end barrier around at least one end of the coil assembly. The annular end barrier is positioned between the coil assembly and the adjacent yoke. In other embodiments, each end of the coil assembly includes an annular end barrier therearound that is positioned between the coil assembly and the adjacent yoke. The annular end barrier(s) insulate the coil assembly from the adjacent yoke and allow the air clearance gap(s) to be reduced. In still other embodiments, the core includes three legs extending between the first and second yokes, and each leg includes a coil assembly therearound, and each end of each coil assembly includes an annular end barrier between the coil assembly and the adjacent yoke.

In one embodiment, the annular end barrier includes an inner portion and an outer portion that together encapsulate the adjacent end of an electrical coil of the coil assembly. The inner portion includes a first cylindrical body portion between an inner side of the electrical coil and a barrier sheet around which the electrical coil is position. The inner portion also includes an outwardly extending flange extending from an end of the cylindrical body portion along an adjacent end of the electrical coil. The outer portion includes a second cylindrical body extending along an outer side of the electrical coil and an inwardly extending flange extending from an end of the second cylindrical body portion in overlapping relation to the outwardly extending flange.

In one embodiment, the electrical coil is a high voltage coil supported on a barrier sheet disposed over the low voltage coil. In still other embodiments, the high voltage coil is wound onto a number of winding support structures that are supported on and about the barrier sheet. The winding support structures include a plurality of teeth defining notches therebetween that are spaced along a length of the winding support structure, and the number of winding support structures are distributed about the perimeter of the barrier sheet to receive windings of the high voltage coil. Spacing members are provided on and about the barrier sheet between the winding support structures to maintain a space between the windings and the barrier sheet. The inner portion of the annular end barrier and a part of the outer portion of the annular end barrier are positioned in a channel defined by the winding support structures.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DETAILED DESCRIPTION OF THE ILLUSTRATED EMBODIMENTS

Figure 1:
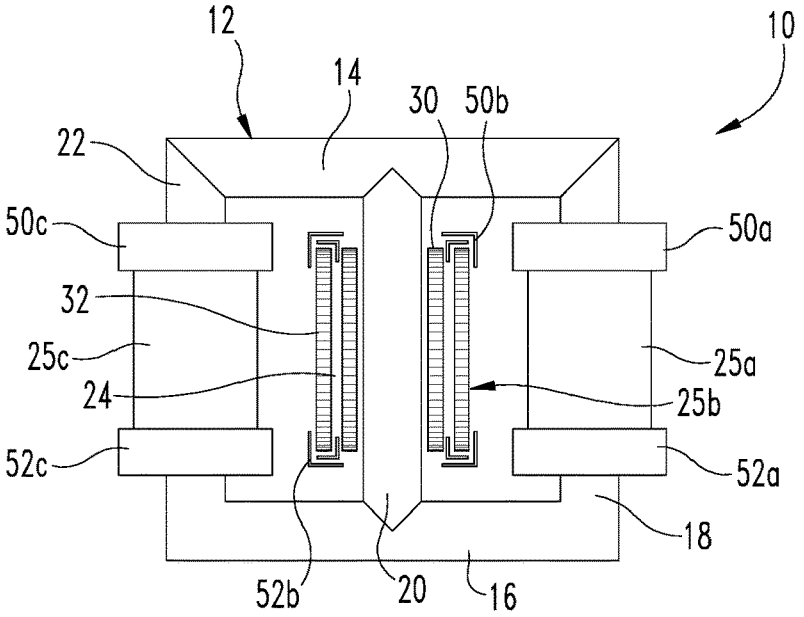
FIG. 1 is a diagrammatic elevation view in partial section of a transformer including a plurality of coil assemblies with annular end barriers between the ends of each coil assembly and an adjacent yoke of the core of the transformer.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring now to FIG. 1, there is shown a diagrammatic elevational view in partial section of a portion of a three phase, open wound dry transformer 10 with opposite annular end barriers 50*a*, 50*b*, 50*c* and 52*a*, 52*b*, 52*c* between a respective end of each coil assembly 25*a*, 25*b*, 25*c* and a core 12. The transformer 10 comprises three coil assemblies 25*a*, 25*b* and 25*c* (one for each phase) mounted to the core 12 and enclosed within a ventilated outer housing (not shown). The core 12 is comprised of ferromagnetic metal, and is generally rectangular in shape. The core 12 includes three spaced-apart legs 18, 20, 22 extending between first and second yokes 14, 16. The coil assemblies 25*a*, 25*b*, 25*c* (also collectively and individually referred to herein as coil assembly 25) are mounted to and disposed around respective ones of the legs 18, 20, 22. Each coil assembly 25*a*, 25*b*, 25*c* includes annular end barriers 50*a*, 50*b*, 50*c* (collectively and individually referred to herein as first annular end barrier 50) at a first end thereof between the respective coil assembly 25 and the adjacent yoke 14, and opposite annular end barriers 52*a*, 52*b*, 52*c* (collectively and individually referred to herein as second annular end barrier 52) at a second end thereof between the respective coil assembly 25 and the adjacent yoke 16. Annular end barriers 50, 52 provide an end insulation barrier between the respective yoke 14, 16 and the adjacent end of the respective coil assembly 25.

Figure 2:
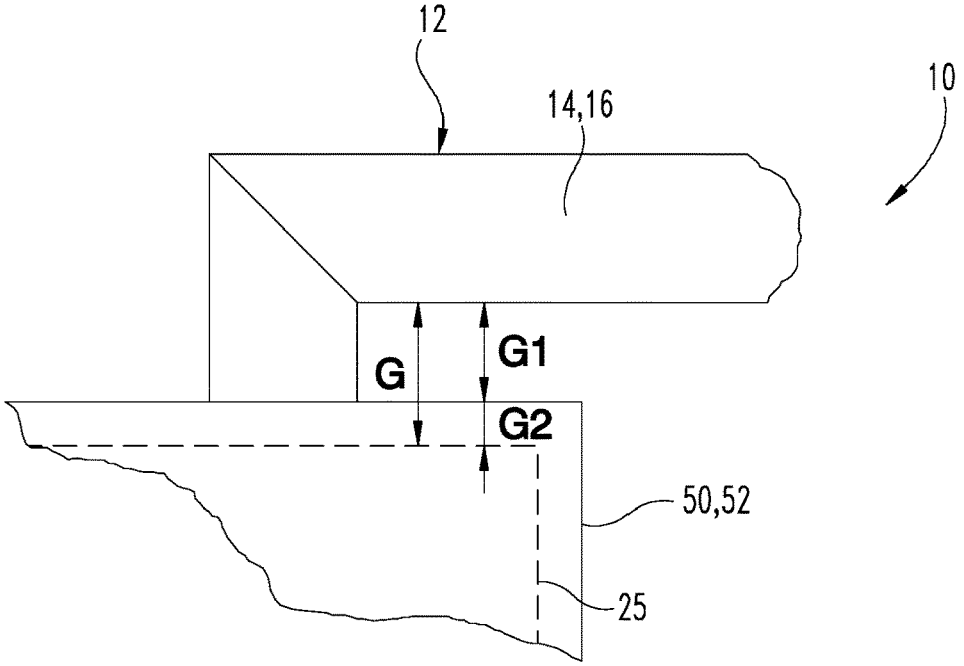
FIG. 2 is an enlarged elevational view of part of the transformer showing a clearance between a yoke of the core and an annular end barrier on the coil assembly.

As shown in FIG. 2, coil assembly 25 is spaced from the adjacent yoke 14, 16 by an air gap G. In addition, each of the first and second end barriers 50, 52 is spaced from an adjacent respective yoke 14, 16 by a first air gap G1, and coil assembly 25 is spaced from the end barrier 50, 52 by a second air gap G2. The air gap G provides clearance between the adjacent yoke 14, 16 and the electric coil assembly 25 to prevent flashover between the coil assembly 25 and the grounded yoke 14, 16. Since the annular end barriers 50, 52 provide an insulation barrier between the coil assembly 25 and the respective yoke 14, 16, the air gap G is reduced relative to a prior art transformer that lacks annular end barrier(s) 50, 52. Therefore, the length of each leg 18, 20, 22 can be reduced since the air gap G distance can be reduced without creating flashover. Although the illustrated embodiment includes end barriers 50, 52 at each end of the coil assembly 25 to minimize the length of each leg 18, 20, 22, embodiments are also contemplated in which an end barrier 50 or 52 is also provided at only one end of each coil assembly 25.

Figure 3A:
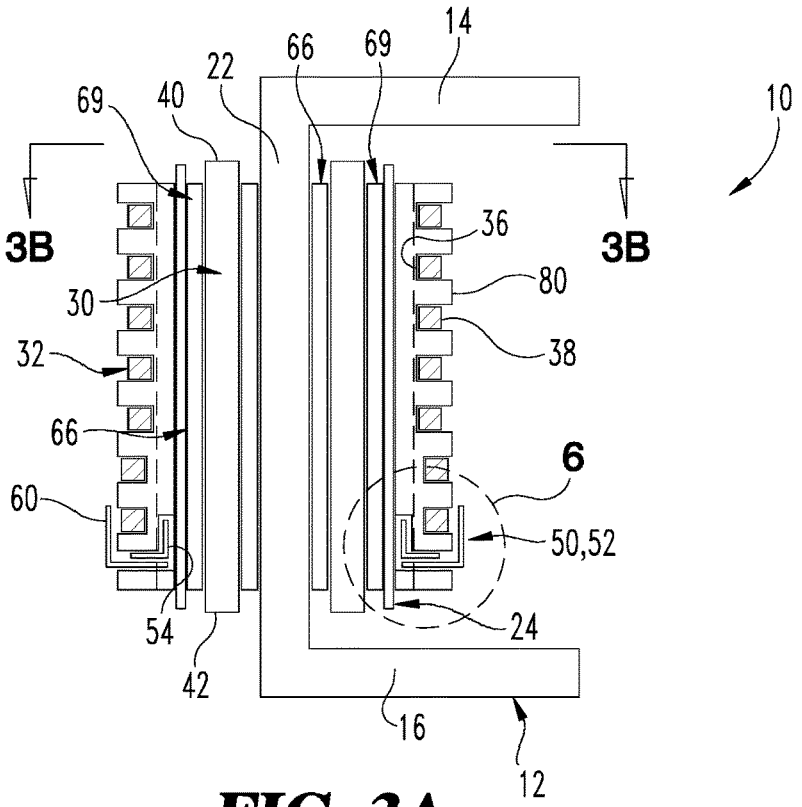
FIG. 3A is a longitudinal sectional view of an embodiment of the coil assembly mounted on the core.

Referring further to the longitudinal section view in FIG. 3A, each coil assembly 25 includes a number of electrical coils, such as a first or high voltage coil 32 and a second or low voltage coil 30, each of which is cylindrical in shape. In FIG. 3A only one end 42 of the coil assembly 25 is shown with an annular end barrier 50, 52, it being understood that the opposite end 40 could also be provided with an annular end barrier 50, 52 as shown in FIG. 1. A barrier sheet 24 is further provided between the coils 30, 32. In one embodiment, barrier sheet 24 is a thin film, wrap, layer, or wall-like member that provides an axially extending dielectric barrier between the low voltage and high voltage coils.

If the transformer 10 is a step-down transformer, the high voltage coil 32 is the primary coil and the low voltage coil 30 is the secondary coil. Alternatively, if the transformer 10 is a step-up transformer, the high voltage coil 32 is the secondary coil and the low voltage coil 30 is the primary coil. In each coil assembly 25, the high voltage coil 32 and the low voltage coil 30 may be mounted concentrically, with the low voltage coil 30 being disposed within and radially inward from the high voltage coil 32. The high voltage coil 32 comprises a plurality of windings 34*a*, 34*b* (FIG. 6) that are wound around and spaced from an outer surface 26 of barrier sheet 24. However, in addition to the disc type windings shown in the illustrated embodiment, any suitable electrical conductor arrangement is contemplated for high voltage coil 32, including layer type windings or other suitable high voltage winding configurations.

In one embodiment, the transformer 10 is a distribution transformer and has a kVA rating in a range of from about 112.5 kVA to about 30,000 kVA. The voltage of the high voltage coil 32 is in a range of from about 600 V to about 35 kV and the voltage of the low voltage coil 30 is in a range of from about 120 V to about 15 kV. However, other types of transformers, ratings and voltages are also contemplated and not precluded.

High voltage coil 32 includes an inner side 36 facing an outer surface 26 of barrier sheet 24 and an opposite outer side 38. Inner side 36 and outer side 38 of high voltage coil 32 extend between a first end 40 and an opposite second end 42 of coil assembly 25. Low voltage coil 30 is located along an inner side 28 of barrier sheet 24. As shown in FIG. 1, first annular end barrier 50 is located across the end of high voltage coil 32 at first end 40 and further extends along the inner and outer sides 36, 38 of high voltage coil 32. Second annular end barrier 52 is located across the end of high voltage coil 32 at second end 42 and further extends along the inner and outer sides 36, 38 of high voltage coil 32.

Figure 4:
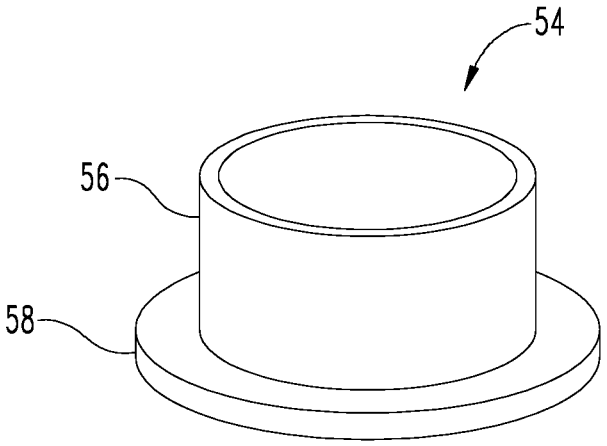
FIG. 4 is a perspective view of an inner portion of the annular end barrier.
Figure 5:
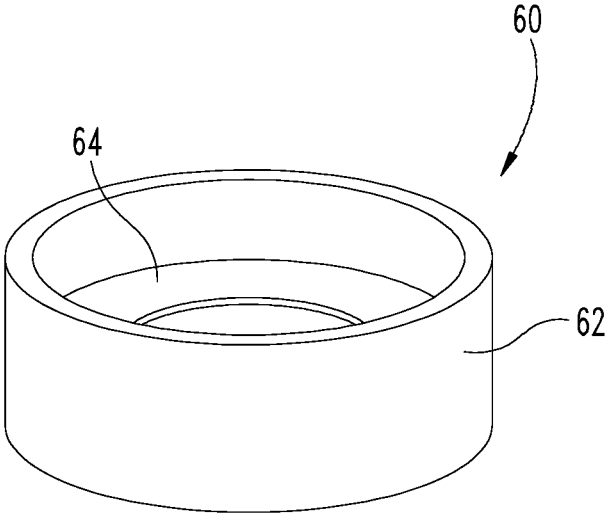
FIG. 5 is a perspective view of an outer portion of the annular end barrier.

Each of the annular end barriers 50, 52 are identical to one another and will be described with reference to one annular end barrier 50, 52, it being understood the description is applicable to the other annular end barrier 50, 52. Annular end barrier 50, 52 includes an inner portion 54 and an outer portion 60. As further shown in FIG. 4, inner portion 54 includes a first cylindrical body portion 56 positioned between inner side 36 of high voltage coil 32 and barrier sheet 24, and a radially outwardly extending flange 58 extending from an outer first end of first cylindrical body portion 56. As further shown in FIG. 5, outer portion 60 includes a second cylindrical body portion 62 positioned along an outer side of high voltage coil 32, and a radially inwardly extending flange 64 extending from an outer second end of second cylindrical body portion 62. The inner and outer portions 54, 60 are positioned so that first and second cylindrical body portions 56, 62 define a space therebetween sized to receive a respective one of the first or second ends of high voltage coil 32 to encapsulate the received end of high voltage coil 32 with flanges 58, 64 in overlapping relation to one another, as show in FIGS. 3A and 6.

Figure 3B:
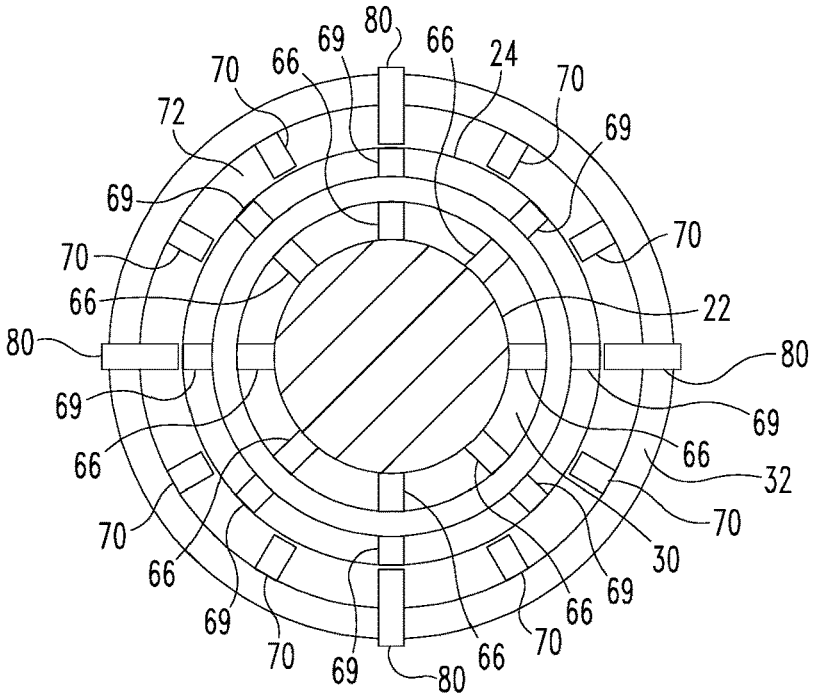
FIG. 3B is a section view of the coil assembly of FIG. 3A looking along line 3B-3B.
Figure 6:
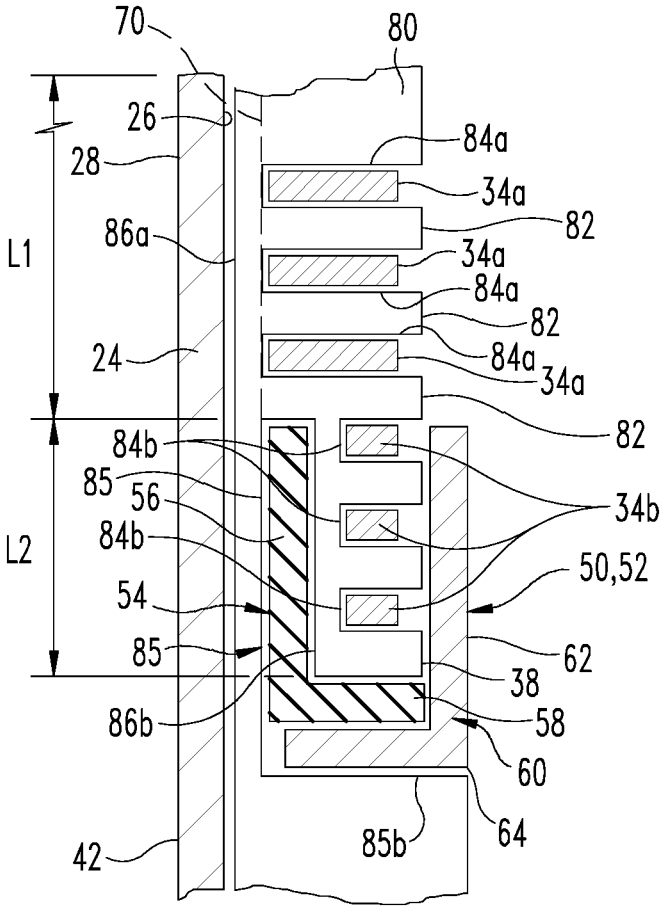
FIG. 6 is an enlarged view of a portion of FIG. 3B showing the annular end barrier and the electrical coil secured to the barrier sheet with a winding support structure.

Referring further to FIG. 3B, inner low voltage coil spacing members 66 are provided around each of the legs, such as shown with respect to leg 22. Inner coil spacing members 66 supports the low voltage coil 32 on leg 22 with an air gap between leg 22 and low voltage coil 30. In addition, barrier spacing members 69 are provided on the outer surface of low voltage coil 30 to support barrier sheet 24 in spaced relation from an outer surface of low voltage coil 30. Referring further to FIG. 6, number of winding support structures 80 are provided on outer surface 26 of barrier sheet 24. Winding support structures 80 extend longitudinally between first and second ends 40, 42. Winding support structures 80 are spaced about a perimeter of barrier sheet 24 and support a plurality of windings 34*a*, 34*b* of high voltage coil 32 in spaced relation from outer surface 26. A number of coil spacing members 70 are also provided on the outer surface 26 of barrier sheet 24 and extend longitudinally between first and second ends 40, 42 on outer surface 26 of barrier sheet 24. Coil spacing members 70 assist winding support structures 80 in maintaining an air space 72 between windings 34*a*, 34*b* and outer surface 26 of barrier sheet 24.

Each winding support structure 80 includes an elongated body with a comb-shaped edge defined by a plurality of teeth 82 with evenly spaced apart notches 84*a*, 84*b* between adjacent teeth 82 for receiving windings 34*a*, 34*b*. Coil spacing member 70 is also positioned on outer surface 26 of barrier sheet 24. Windings 34*a* are received in middle notches 84*a*. End notches 84*b* are located adjacent the respective ends 40, 42 and are shallower than middle notches 84*a* so that end notches 84*b* receive reduced height windings 34*b*. This allows winding support structure 80 to receive and support annular end barrier 50, 52 while not interrupting air flow between barrier sheet 24 and high voltage coils 32.

Winding support structure 80 includes an inward face 86*a* that is supported on outer surface 26 of barrier sheet 24. Winding support structure 80 also defines an L-shaped channel 85 for receiving the respective annular end barrier 50, 52 therein. The L-shaped channel includes an axially extending portion 85*a* to receive the first cylindrical body portion 56 of inner portion 54 and a radially extending portion 85*b* to receive the flanges 58, 64 of inner and outer portions 54, 60, respectively. First notches 84*a* extend along a first length L1 that is at least half of the overall length of barrier sheet 24 between ends 40, 42. Second notches 84*b* and axially extending portion 85*a* extend along a second length L2 that is defined by, for example, three end notches 84*b*. In one embodiment second length L2 is less than a fourth of the length of barrier sheet 24 between ends 40, 42. More or fewer than three end notches 84*b* are provided in other embodiments, and length L2 extends along the corresponding number of end notches 84*b*. The L-shaped channel 85 is positioned so the inserted annular end barrier 50, 52 is spaced from barrier sheet 24 and will not block cooling air flow in the air gap 72 between barrier sheet 24 and windings 34*a*, 34*b*.

Inner portion 54 of annular end barrier 50, 52 is positioned with first cylindrical body portion 56 in axially extending portions 85*a* of channel 85, and radially outwardly extending flange 58 extending along radially extending portion 85*b* of channel 85 at a respective first or second end of high voltage coil 32 to outer side 38 of high voltage coil 32. Outer portion 60 of annular end barrier 50, 52 is positioned with second cylindrical body portion 62 along outer side 38 of high voltage coil 32, and radially inwardly extending flange 64 extends along the radially extending portion 85*b* of channel 85 at the respective first or second end of high voltage coil 32 on the outside of and in overlapping relation with radially outwardly extending flange 58. In one embodiment, annular end barriers 50, 52 form a complete circular shape that goes around the entire high voltage coil 32. In another embodiment, annular end barriers are segmented or provided in multiple pieces to encapsulate only the portion(s) of the high voltage coil 32 that is under or closest to the yoke 14, 16. A multi-segmented or pieced end barrier 50, 52 can improve manufacturability while providing sufficient dielectric protection between the coil and the yoke.

The sheet member 24 is composed of an insulating, dielectric material, such as sheet insulation, polymer film, plastic film, insulation paper, or a non-conductive dielectric plastic material. Coil spacing members 70, winding support structures 80 and annular end barriers 50, 52 can be made from any suitable material, such as a fiber reinforced plastic in which fibers, such as fiberglass fibers, are impregnated with a thermoset resin, such as a polyester resin, a vinyl ester resin, or an epoxy resin. Annular end barriers 50, 52 can also include components that are molded into the desired shape using, for example, fiber reinforced plastic, polymer, or paper material. The annular end barriers 50, 52 can also be made from sheet insulation material, such as paper, polyester, polymer, composite, or other suitable materials that can be cut and folded into the desired shape of the annular end barrier components.

The coil spacing members 70 and winding support structures 80 can be arranged in an alternating manner around the outer circumference of the barrier sheet 24, with the coil spacing members 70 and winding support structures 80 being substantially evenly spaced apart around the circumference of the barrier sheet 24 and secure thereto with bands, adhesive, fasteners, or other suitable connecting means, or integrally molded therewith.

Although the transformer 10 is shown and described as being a three phase transformer, it should be appreciated that the present invention is not limited to three phase transformers. For example, the present invention may be utilized in single phase transformers as well.

Various aspects of the present disclosure are contemplated. For example, according to one aspect, a transformer includes a core with opposite first and second yokes and at least one leg extending between the first and second yokes. A low voltage coil extends around the at least one leg, a barrier sheet extends around the low voltage coil, and a high voltage coil extends around the barrier sheet and between opposite first and second ends of the high voltage coil. The transformer includes an annular end barrier between the first end of the high voltage coil and the first yoke. The annular end barrier is configured to extend annularly around an outer side of the high voltage coil at the first end of the high voltage coil, and is further configured to extend annularly between the barrier sheet and an inner side of the high voltage coil at the first end of the high voltage coil.

In an embodiment, the transformer includes a second annular end barrier between the second end of the high voltage coil and the second yoke. In another embodiment, the annular end barrier extends along three or less windings of the high voltage coil.

In yet another embodiment, the annular end barrier includes an inner portion between the outer surface of the barrier sheet and the inner side of the high voltage coil, and the annular end barrier further includes an outer portion along the outer side of the high voltage coil. In a refinement of this embodiment, the inner portion of the annular end barrier includes an outwardly extending flange extending along the first end of the high voltage coil and the outer portion of the annular end barrier includes an inwardly extending flange extending along the first end of the high voltage coil in overlapping relation to the outwardly extending flange. In a further refinement, a number of winding support structures on the outer surface of the barrier sheet support the high voltage coil, the number of winding support structures each defining a slot for receiving the annular end barrier. In yet a further refinement, the inner portion of the annular end barrier is supported on the winding support structures.

In another refinement of the previous embodiment, the inner portion of the annular end barrier includes a first cylindrical body portion extending along a part of a length of the winding support structure between the barrier sheet and the inner side of the high voltage coil and a first flange extending radially outwardly from a first end of the cylindrical body portion. In a refinement of this embodiment, the outer portion of the annular end barrier includes a second cylindrical body portion extending along the outer side of the high voltage coil and a second flange extending radially inwardly from a second end of the second cylindrical body portion in overlapping relation with the first flange.

In another embodiment, the high voltage coil is supported on the barrier sheet by a number of winding support structures and a number of coil support structures, and each winding support structure includes a plurality of spaced apart notches for receiving respective windings of the high voltage coil. In a refinement of this embodiment, a first part of the plurality of notches defines a first depth and a second part of the plurality of notches defines a second depth, wherein the second depth is less than the first depth, and the second part of the plurality of notches are located along the annular end barrier. In yet a further refinement, each of the winding support structures defines an L-shaped notch for receiving the annular end barrier.

In another embodiment, the core includes three legs extending between the first and second yokes. Each of the legs includes a respective low voltage coil extending therearound, a respective barrier sheet extending around the respective low voltage coil, a respective high voltage coil extending around the respective barrier sheet between opposite first and second ends of the respective high voltage coil, and a respective first annular end barrier between the first end of the respective high voltage coil and the first yoke, and a respective second annular end barrier between the second end of the respective high voltage coil and the second yoke.

In another aspect, a transformer includes a core with opposite first and second yokes and at least one leg extending between the first and second yokes. The transformer also includes a first electrical coil extending around the at least one leg, a barrier sheet around the first electrical coil, and a second electrical coil extending around the barrier sheet between opposite first and second ends. A first annular end barrier provides insulation between the first end of the second electrical coil and the first yoke and a second annular end barrier provided insulation between the second end of the second electrical coil and the second yoke.

In one embodiment, the first electrical coil is a low voltage coil and the second electrical coil is a high voltage coil. In another embodiment, each of the first and second annular end barriers is configured to extend annularly around an outer side of the second electrical coil at the respective first or second end of the second electrical coil, and the first and second annular end barriers are further configured to extend annularly between the barrier sheet and an inner side of the second electrical coil at the respective first or second end of the second electrical coil.

In a refinement of these embodiments, each of the first and second annular end barriers includes an inner portion having a first cylindrical body portion between an inner side of the second electrical coil and the barrier sheet and a radially outwardly extending flange projecting from a first end of the first cylindrical body portion along an adjacent first or second end of the second electrical coil. In a further refinement, each of the first and second annular end barriers includes an outer portion having a second cylindrical body portion around an outer surface of the second electrical coil and a radially inwardly extending flange projecting from a second end of the second cylindrical body portion along the radially outwardly extending flange.

In a further embodiment, the first and second annular end barriers completely encapsulate the respective first or second end of the second electrical coil. In yet another embodiment, the barrier sheet and first and second annular end barriers are composed of fiber-reinforced plastic.

According to another aspect, an insulation barrier for a transformer is disclosed. The insulation barrier includes an inner portion including a first cylindrical body and a radially outwardly extending flange extending from a first end of the first cylindrical body. The insulation barrier also includes an outer portion including a second cylindrical body and a radially inwardly extending flange extending from a second end of the second cylindrical body in overlapping relation with the radially outwardly extending flange of the inner portion. The first and second cylindrical body portions are spaced from one another to form a space sized to receive a high voltage coil between the first and second cylindrical bodies.

In one embodiment, the inner and outer portions are composed non-conductive dielectric plastic. In yet another embodiment, the radially inwardly extending flange is located between the space and the radially outwardly extending flange.

While the invention has been illustrated and described in detail in the drawings and foregoing description, the same is to be considered as illustrative and not restrictive in character, it being understood that only the certain embodiments have been shown and described and that all changes and modifications that come within the spirit of the inventions are desired to be protected. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. Unless specified or limited otherwise, the terms "engaged," "connected," "supported," and "coupled" and variations thereof are used broadly and encompass both direct and indirect engagements, connections, supports, and couplings.

What is claimed is:

1. A transformer, comprising:

a core including opposite first and second yokes and at least one leg extending between the first and second yokes;

a low voltage coil extending around the at least one leg;

a barrier sheet extending around the low voltage coil;

a high voltage coil extending around the barrier sheet and between opposite first and second ends of the high voltage coil;

a number of winding support structures on the outer surface of the barrier sheet that support the high voltage coil; and an annular end barrier between the first end of the high voltage coil and the first yoke, the annular end barrier being configured to extend annularly around an outer side of the high voltage coil at the first end of the high voltage coil, the annular end barrier further being configured to extend annularly between the barrier sheet and an inner side of the high voltage coil at the first end of the high voltage coil, wherein the annular end barrier includes an inner portion and an outer portion between the first end of the high voltage coil and the first yoke, wherein the inner portion includes a cylindrical body portion that is supported in channels of the winding support structures between the outer surface of the barrier sheet and the inner side of the high voltage coil, the inner portion further including a first flange extending radially outwardly from the cylindrical body portion, and the outer portion is positioned along the outer side of the high voltage coil and overlaps the inner portion at the first end of the high voltage coil.

2. The transformer of claim 1, further comprising a second annular end barrier between the second end of the high voltage coil and the second yoke.

3. The transformer of claim 1, wherein the annular end barrier extends along three or less windings of the high voltage coil.

4. The transformer of claim 1, wherein the outer portion of the annular end barrier includes an inwardly extending flange extending along the first end of the high voltage coil in overlapping relation to the outwardly extending flange of the inner body portion.

5. The transformer of claim 1, wherein the number of winding support structures each define a channel for receiving the annular end barrier.

6. The transformer of claim 5, wherein the inner portion of the annular end barrier is supported on the number of winding support structures.

7. The transformer of claim 5, wherein the cylindrical body portion of the inner portion extends along a part of a length of the winding support structures on the inner side of the high voltage coil.

8. The transformer of claim 1, wherein the outer portion of the annular end barrier includes a second cylindrical body portion extending along the outer side of the high voltage coil and a second flange extending radially inwardly from a second end of the second cylindrical body portion in overlapping relation with the first flange.

9. The transformer of claim 1, wherein each winding support structure includes a plurality of spaced apart notches for receiving respective windings of the high voltage coil.

10. A transformer, comprising:

a core including opposite first and second yokes and at least one leg extending between the first and second yokes;

a low voltage coil extending around the at least one leg;

a barrier sheet extending around the low voltage coil;

a high voltage coil extending around the barrier sheet and between opposite first and second ends of the high voltage coil; and an annular end barrier between the first end of the high voltage coil and the first yoke, the annular end barrier being configured to extend annularly around an outer side of the high voltage coil at the first end of the high voltage coil, the annular end barrier further being configured to extend annularly between the barrier sheet and an inner side of the high voltage coil at the first end of the high voltage coil, wherein the high voltage coil is supported on the barrier sheet by a number of winding support structures and a number of coil spacing members, each winding support structure including a plurality of spaced apart notches for receiving respective windings of the high voltage coil, and wherein a first part of the plurality of notches defines a first depth and a second part of the plurality of notches defines a second depth, wherein the second depth is less than the first depth, and the second part of the plurality of notches are located along the annular end barrier.

11. The transformer of claim 10, wherein each of the winding support structures includes an L-shaped channel for receiving the annular end barrier therein along the second part of the plurality of notches.

12. The transformer of claim 1, wherein the core includes three legs extending between the first and second yokes, wherein each of the legs includes:

a respective low voltage coil extending therearound;

a respective barrier sheet extending around the respective low voltage coil;

a respective high voltage coil extending around the respective barrier sheet between opposite first and second ends of the respective high voltage coil; and a respective first annular end barrier between the first end of the respective high voltage coil and the first yoke, and a respective second annular end barrier between the second end of the respective high voltage coil and the second yoke.

13. A transformer, comprising:

a core including opposite first and second yokes and at least one leg extending between the first and second yokes;

a first electrical coil extending around the at least one leg;

a second electrical coil extending around the first electrical coil, the second electrical coil further extending between opposite first and second ends;

a barrier sheet positioned between the first electrical coil and the second electrical coil, the barrier sheet extending around the first electrical coil and between the opposite first and second ends of the second electrical coil;

a number of winding support structures on the outer surface of the barrier sheet that support the second electrical coil; and a first annular end barrier providing insulation between the first end of the second electrical coil and the first yoke and a second annular end barrier providing insulation between the second end of the second electrical coil and the second yoke, wherein the number of winding support structures each define at least one channel for receiving a portion of at least one of the first and second annular end barriers therein.

14. The transformer of claim 13, wherein the first electrical coil is a low voltage coil and the second electrical coil is a high voltage coil.

15. The transformer of claim 13, wherein the first annular end barrier is configured to extend annularly around an outer side of the second electrical coil at the first end of the second electrical coil, and the first end barrier further being configured to extend annularly between the barrier sheet and an inner side of the second electrical coil at the first end of the second electrical coil, wherein the second annular end barrier is configured to extend annularly around the outer side of the second electrical coil at the second end of the second electrical coil, and the second annular end barrier further being configured to extend annularly between the barrier sheet and the inner side of the second electrical coil at the second end of the second electrical coil.

16. The transformer of claim 15, wherein each of the first and second annular end barriers includes an inner portion having a first cylindrical body portion between an inner side of the second electrical coil and the barrier sheet and a radially outwardly extending flange projecting from a first end of the first cylindrical body portion along an adjacent first or second end of the second electrical coil.

17. The transformer of claim 16, wherein each of the first and second annular end barriers further includes an outer portion having a second cylindrical body portion around an outer surface of the second electrical coil and a radially inwardly extending flange projecting from a second end of the second cylindrical body portion along the radially outwardly extending flange.

18. The transformer of claim 13, wherein the first and second annular end barriers completely encapsulate the respective first or second end of the second electrical coil.

19. The transformer of claim 13, wherein the first and second annular end barriers are comprised of fiber-reinforced plastic.

* * * * *